United States Patent [19]

Rezin

[11] 4,242,847

[45] Jan. 6, 1981

[54] MODULAR LIFT STATION CONSTRUCTION

[75] Inventor: Robert G. Rezin, Tomah, Wis.

[73] Assignee: Universal Sanitary Equipment Manufacturing Co., Inc., Tomah, Wis.

[21] Appl. No.: 973,637

[22] Filed: Dec. 27, 1978

[51] Int. Cl.[3] ..... E02D 29/12; E03F 5/22

[52] U.S. Cl. ..... 52/169.6; 52/20; 52/245; 52/79.7

[58] Field of Search ..... 52/20, 245, 169.6, 79.7, 52/584; 417/360

[56] References Cited

U.S. PATENT DOCUMENTS

| | | | |
|---|---|---|---|
| 3,038,565 | 6/1962 | Bruce | 52/169.6 X |
| 3,461,803 | 8/1969 | Stothoff et al. | 52/20 X |
| 3,672,103 | 6/1972 | Kost | 52/169.6 X |
| 3,956,860 | 5/1976 | Andrews | 52/245 |
| 3,996,630 | 12/1976 | Maderna | 52/169.6 X |

FOREIGN PATENT DOCUMENTS

| | | | |
|---|---|---|---|
| 295095 | 10/1969 | Australia | 52/192 |
| 1143627 | 2/1963 | Fed. Rep. of Germany | 52/169.6 |
| 1192648 | 4/1959 | France | 52/584 |
| 527920 | 10/1940 | United Kingdom | 52/245 |

*Primary Examiner*—Alfred C. Perham

*Attorney, Agent, or Firm*—Merchant, Gould, Smith, Edell, Welter & Schmidt

[57] ABSTRACT

An enclosure for housing industrial equipment and which is adapted to be buried underground. The enclosure includes at least two sections having a common top wall and floor. Each of the sections includes vertically extending sidewalls that are curved outwardly to define a generally convex outer surface. The sections are disposed adjacent to each other along an elongation axis with sidewalls of adjacent sections joined to each other along substantially vertical lines to define an enclosed equipment chamber. The present invention also includes a modular enclosure incorporating at least two modular members that are adapted to be joined together with each modular member including at least one section with a top wall, floor, and outwardly sidewalls. An opening is provided in the sidewall of each modular member and is defined by generally vertical seams. An apparatus is provided for joining the modular members together along mating vertical seams to define an enclosed chamber.

2 Claims, 11 Drawing Figures

MODULAR LIFT STATION CONSTRUCTION

BACKGROUND OF THE INVENTION

The present invention relates broadly to underground enclosures for industrial equipment and in particular to underground sewage lift stations and/or water booster stations.

In some sewage or water systems pumping stations are provided at various locations throughout the system to establish sewage or water flow from one location to another. Such pumping or lift stations are particularly necessary when the fluid being transported must be pumped up hill or on an upgrade due to the topography of the land. Typically, such pumping stations are buried in the ground as are the sewage or water lines themselves. Prior art pumping stations are underground enclosures in which sewage or water pumps are installed. Depending on the pumping capacity required, one or more such pumps may be used at each station and the size of the station will vary accordingly. The underground enclosure houses, in addition to the pumps themselves, other supporting equipment for the pumps such as pump electrical control switch boxes, etc. The stations, or enclosures, may be buried at varying depths in the earth depending upon the requirements of a particular system. The walls of the underground enclosure must be able to withstand the pressure of the surrounding earth. The prior art underground lift stations are typically elongated enclosures with planar side walls. To provide adequate side wall strength the prior art enclosures included a plurality of I-beams affixed to the side walls. Crossed I-beams are also affixed to the outer surface of the roof and floor of the prior art enclosures.

The present invention provides an enclosure with side walls having substantially the same if not greater strength than the prior art enclosures but which reduces the number of required I-beam supports on the side walls significantly reducing the weight of the enclosure. Additionally, the enclosure of the present invention that has the same exterior dimension as a prior art enclosure will, on the other hand, have significantly more usable interior space than the similar sized prior art enclosure. The present invention thus is an enclosure having significant advantages over the prior art.

SUMMARY OF THE INVENTION

The present invention is an enclosure for housing industrial equipment and which is adapted to be buried underground. The enclosure includes at least two sections with a common top wall and floor with each of the sections having generally vertically extending side walls between the top wall and the floor. Each side wall is curved outwardly to define a generally convex outer surface and the two sections are disposed adjacent each other along an elongation axis with the side walls of adjacent sections joined to each other along substantially vertical lines to define an enclosed equipment chamber. Reinforcing members are secured to the two sections along the substantially vertical lines where the two sections are joined together. In the preferred embodiment, the top wall and floor and side walls are formed of steel and the reinforcing members are steel I-beams.

In the preferred embodiment, the present invention is an enclosure adapted to be buried underground which includes a roof, floor and side walls defining an enclosed chamber. The side wall includes a plurality of side wall sections, each section having lateral edges disposed generally vertically and with each side wall section curved outwardly between the lateral edges to define a generally convex outer surface. Adjacent side wall sections are joined to each other along adjacent lateral edges and reinforcing members may be affixed to the outer surface of the side wall along the generally vertical joints between adjacent side wall sections. The enclosure has a generally horizontal elongation axis and each of the side wall sections has a radius of curvature measured from points spaced along the elongation axis. In the preferred embodiment the enclosure includes first and second end portions each of which comprises a section of a cylinder with a substantially vertical central axis. At least two side wall sections which are oppositely disposed about the elongation axis are positioned intermediate the end portion to connect the end portions together. The side wall sections curve outwardly defining a generally concave outer surface.

The curvature of the side walls of the present invention provide the side walls with sufficient strength to withstand the pressures of being buried in the earth. In the preferred embodiment of the present invention the roof, floor and side wall of the enclosure is formed of steel. The side wall is provided with supporting members only at the joints between side wall sections. The outward curvature of the side walls also increase the interior usable space of the enclosure as compared to a prior art enclosure with substantially planar side walls and identical exterior dimensions.

The present invention also encompasses a modular enclosure for housing industrial equipment and which is also adapted to be buried underground. The modular enclosure includes at least two modular members adapted to be joined together with each modular member having at least one section with a top wall, floor, and outwardly curved side walls. First and second generally vertical seams define an opening in the side wall of each modular member. Means are provided for joining the modular members together along mating vertical seams to define an enclosed chamber.

Thus the present invention is an underground enclosure for industrial equipment that can be either prefabricated and shipped to the installation site or can be prefabricated in modular units which can be shipped independently and then assembled on site for installation. By virtue of the flexible modular design an underground enclosure tailored to meet specific user requirement can be easily designed and fabricated. Large modular stations may be fabricated and shipped in multiple sections for field assembly. Thus an essentially unlimited size and configuration of station can be factory built. The enclosure of the present invention is designed to withstand the pressures of burial beneath the earth surface while at the same time substantially reducing the need for significant reinforcement required in prior art enclosures. Typically, an enclosure of the present invention which has the same external dimension as a prior art enclosure can be manufactured with thousands of pounds less weight and in addition will have significantly more interior usable space as compared with the prior art enclosure. The weight savings is achieved by virtue in the reduction in the need for side wall reinforcements, typically steel I-beams, resulting in reduced manufacturing costs and reduced transport costs from assembly plant to installation location. The amount of welding required in the manufacture and assembly of the enclosure of the present invention is significantly reduced and the enclosure has less dependence for its strength on such welds. These and other advantages of the present invention will become apparent with reference to the accompanying drawings, detailed description of the preferred embodiment, and the claims.

DETAILED DESCRIPTION OF THE PREFERRED EMBODIMENT

Figure 1:
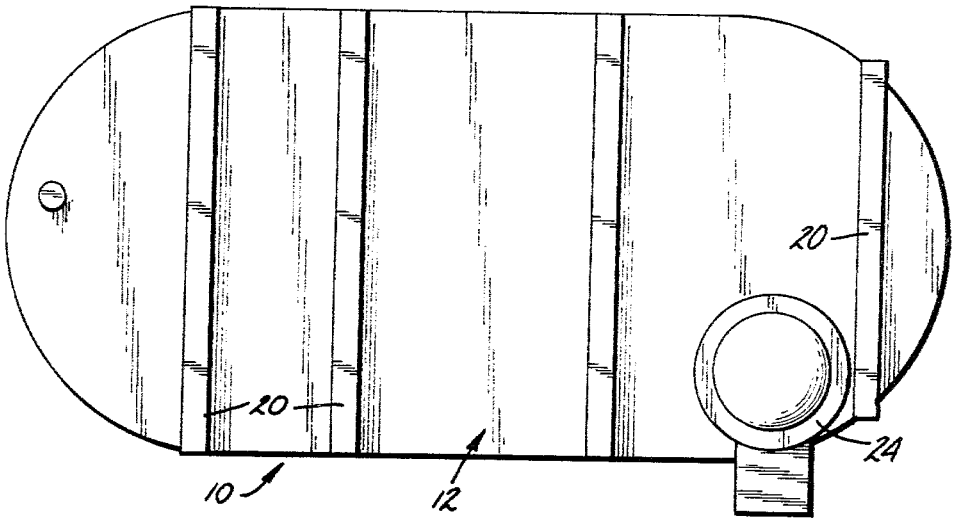
FIG. 1 is a top plan view of one embodiment of the present invention.
Figure 2:
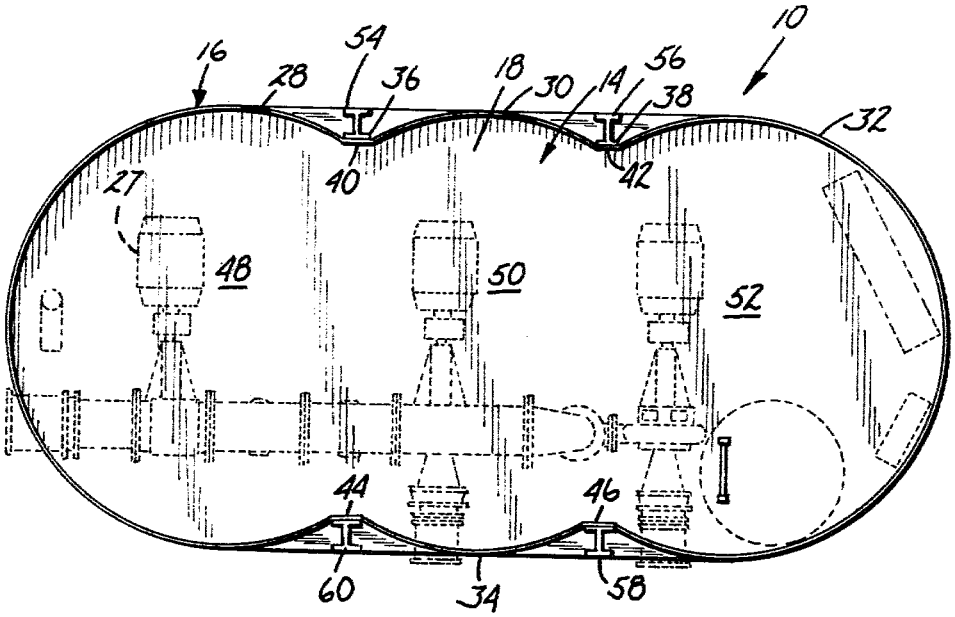
FIG. 2 is a top plan view similar to FIG. 1 but with the roof or top wall of the enclosure removed.
Figure 3:
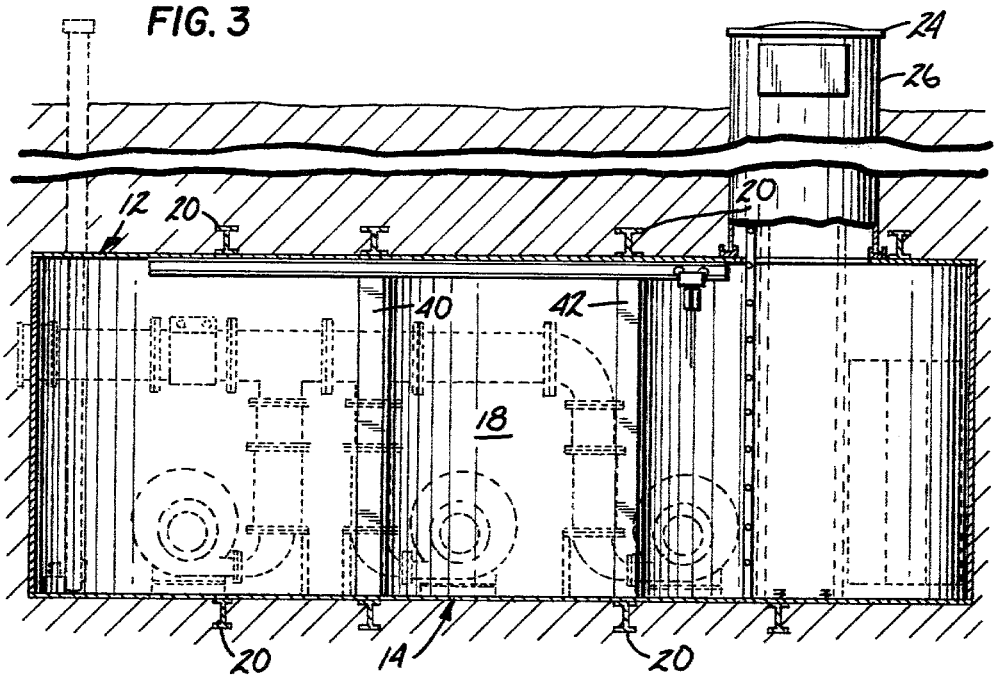
FIG. 3 is a sectional view in elevation showing the placement of the enclosure of the present invention beneath the earth's surface.

Referring to the drawings, wherein like numerals represent like parts throughout the several views, FIG. 1 is a top plan view of a typical embodiment of the underground enclosure of the present invention, designated generally at 10. FIG. 2 is also a top plan view of enclosure 10 with the roof thereof removed while FIG. 3 is a view in side elevation illustrating the placement of enclosure 10 beneath the earth surface at a depth X. Enclosure 10 includes a top wall or roof 12, a floor 14 and a side wall designated generally at 16. In the preferred embodiment, roof 12, floor 14 and side wall 16 are formed of steel, but it should be understood that alternative equivalent material having comparable strength characteristics could also be utilized within the spirit and scope of the present invention. Roof 12 and floor 14 are typically welded to side wall 16 to define an enclosed chamber 18 in which industrial equipment may be housed. Roof 12 and floor 14 may be provided with a series of I-beams 20 affixed thereto to provide strength and structural support. In the embodiment disclosed herein, I-beams 20 are aligned generally transverse with respect to a generally horizontal elongation axis.

Roof 12 is provided with an opening at 24 for entry into chamber 18. A tubular member 26 is typically mounted to enclosure 10 about opening 24 and extends above the ground surface. A ladder or one-man elevator may be installed within tubular member 26 to facilitate above ground access through tubular member 26 into enclosure 10 to monitor operation of the equipment therein and/or to perform maintenance functions.

As stated previously, industrial equipment typically pumps and the like may be mounted within enclosure 18. A typical equipment installation is illustrated in dashed lines at 27 to include a plurality of waste water pumps and inlet and outlet conduits. Such equipment does not form a part of the present invention, however, and therefore no detailed description of this equipment is considered necessary.

Side wall 16 of enclosure 10 includes a plurality of sections 28, 30, 32 and 34 which are curved outwardly to define a generally convex outer surface. In the embodiment shown in FIG. 2, sections 28 and 32 comprise end portions of side wall 16 while sections 30 and 34 are intermediate side wall portions. With particular reference to section 30, side wall sections 28–34 may be defined as having lateral edges as at 36 and 38 which lie along lines generally normal to roof 12 and floor 14. Sections 28–34 are curved outwardly between the lateral edges of each section. Adjacent side wall sections 28–34 are interconnected or joined to each other along said lateral edges to define inwardly disposed apex portions 40, 42, 44 and 46 of side wall 16. In the preferred embodiment, sections 28–34 are sections of a cylinder with a radius of curvature taken from points spaced apart along the elongation axis of enclosure 10. Sections 28–34 define a plurality of interconnected equipment areas 48, 50 and 52 within enclosed chamber 18.

Exterior support members 54, 56, 58 and 60, which in a preferred embodiment are I-beams may be welded to the outer surface of side wall 16 generally at the juncture of adjacent side wall sections 28–34. Support members 54–58 extend between and may also be welded to roof 12 and floor 14. The outward curvature of side wall sections 28–34 provides inherent strength of side wall 16 eliminating the need for the number of side wall I-beam supports required in the prior art structures. The usable interior space of enclosed chamber 18 is also significantly increased over prior art structures having the same lateral or transverse dimension measured from the exterior of the I-beam supports 54–58. It is contemplated, within the spirit and scope of the present invention, that side wall sections 28–34 may be integrally formed with each other or may be separately formed and welded to each other along adjacent lateral edges. Alternatively the lateral edges of each side wall section 28–34 may be welded to I-beams 54–60 such that the inward base portion of the I-beams form a portion of sidewall 16 and interconnect adjacent side wall sections. As previously mentioned, sections 28–34 are in the preferred embodiment simply curved steel plates, the curvature of which provides the side wall structural support.

Figure 6:
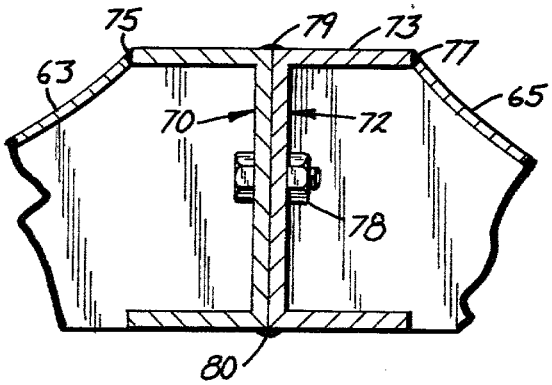
FIG. 6 is an enlarged fragmentary view illustrating the connection of adjacent modular members of the enclosure of the present invention.
Figure 4:
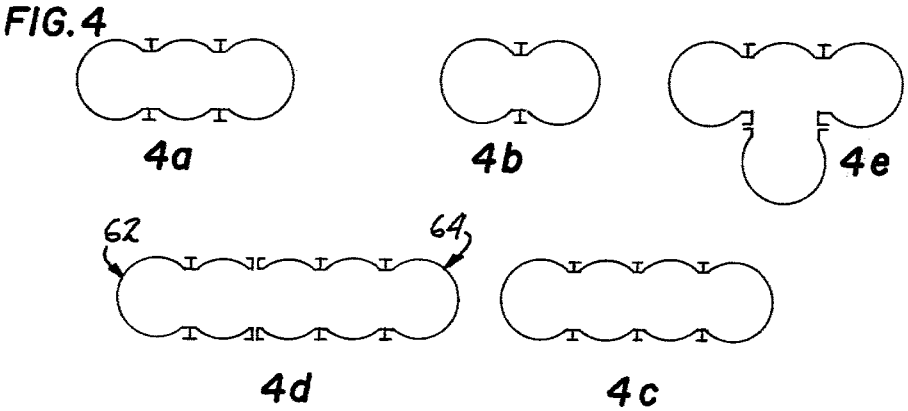
FIG. 4 is a diagrammatic view illustrating several alternative embodiments of the enclosure of the present invention.
Figure 5:
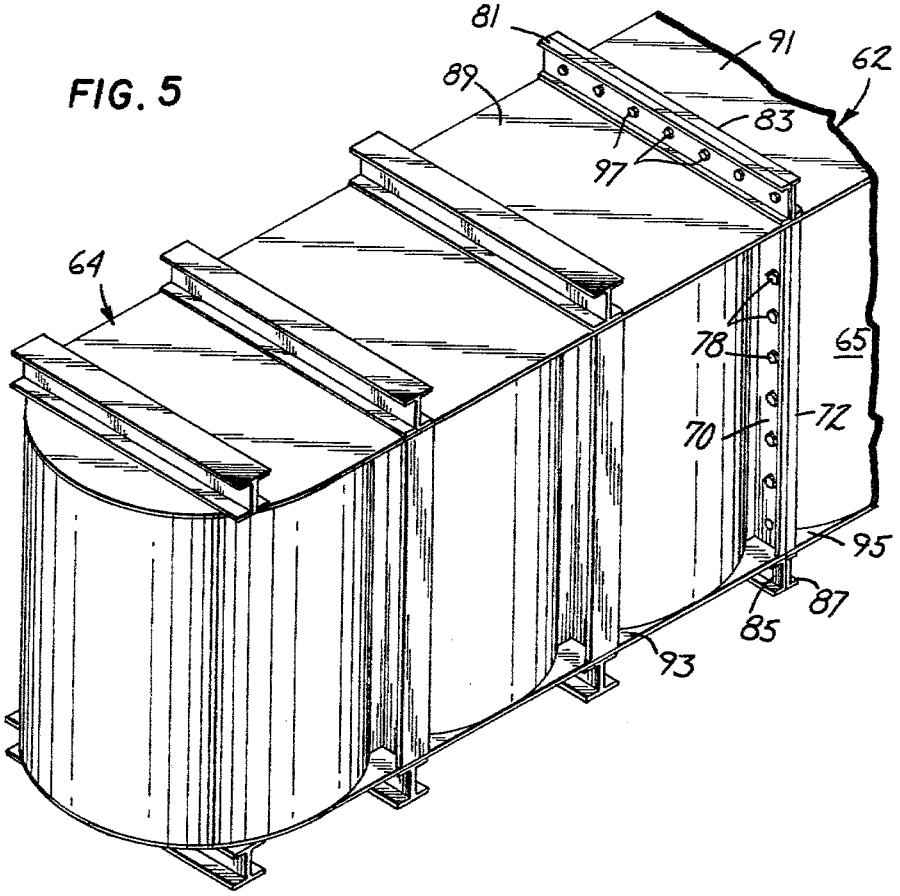
FIG. 5 is a fragmentary view in perspective illustrating the modular embodiment of the enclosure of the present invention.
Figure 7:
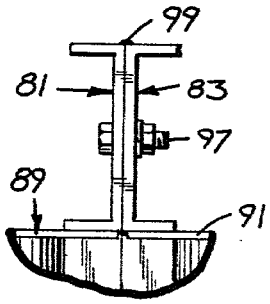
FIG. 7 is an enlarged fragmentary view illustrating the roof and floor connection of adjacent modular members.

Enclosure 10 may be constructed with any desired number of defined equipment areas 48–52. FIG. 4 shows a number of possible structures, but it should be understood that FIG. 4 is by no means exclusive of enclosure configurations within the spirit and scope of the present invention. FIG. 4*a*, for example, simply illustrates the structure of enclosure 10 which has been illustrated and described with reference to FIGS. 1–3. FIG. 4*b* illustrates a structure having simply two end sections while FIG. 4*c* shows an embodiment incorporating two pair of oppositely disposed intermediate side wall sections providing a longer enclosure than that described above. The FIGS. 4*a*–4*c* illustrate typical factory assembled, prefabricated enclosures that may simply be shipped to the desired installation location and buried in the ground. FIG. 4*d*–4*e* on the other hand, disclose an enclosure of modular construction. With reference to FIG. 4*d* and FIGS. 5–7 two sections 62 and 64 may be prefabricated and assembled at a factory and then connected together at the installation location. Each modular member 62 and 64 includes at least one section having an outwardly curved side wall 63 and 65. A means for securing modular members 62 and 64 to each other is shown in more detail in the enlarged view of FIGS. 6 and 7. Each modular member 62 and 64 has an open end defined by the lateral edges of a side wall section. FIG. 6 shows the connection of modular members to each other at one side of the enclosure, it being understood that the connection at the opposite side of the enclosure is identical while FIG. 7 illustrates the connection at the roof and floor.

In the modular construction, side walls 63 and 65 adjacent the open end of the modular members 62 and 64 have flange members 70 and 72 disposed at the outward lateral edges thereof. Flange members 70 and 72 are typically channel members that are U-shaped in cross-section. Flange members have leg portions 71 and 73 to which side walls 63 and 65 are welded along the lateral edges at 75 and 77, respectively. Leg portions 71 and 73 are welded to each other at 79. Flange members 70 and 72 have substantially planar plate portions 74 and 76 which extend outward with respect to side wall section 63 and 65. A plurality of nut and bolt fastening means 78 may be provided to secure plate portions 74 and 76 together while flange members 70 and 72 are welded together at 79 and 80 to insure water tight integrity of the modular enclosure. Channel members 81, 83, 85, and 87 are provided and welded to roof 89 and 91 and floors 93 and 95 of sections 64 and 62, respectively. A plurality of fasteners 97 are provided to join adjacent channel members which are welded together at 99.

From the above description, it can be seen that the present invention is an enclosure adapted to be buried underground for housing of industrial equipment and which is structurally sound while at the same time eliminating significant weight from prior art enclosures that necessitate greater numbers of reinforcing members. The enclosure of the present invention also provides for more interior workable space than prior art structures having equivalent maximum external dimensions. The present invention is also a modular construction enclosure which can be manufactured in prefabricated sections at the manufacturing facility with the modular sections joined together at the site installation. Such prefabricated modular units can be structured to meet the specific needs and requirements of any particular user or customer.

I claim:

1. An enclosure for housing industrial equipment suitable to be buried underground, comprising:

at least two sections having a common top wall and floor, each of said sections having vertically extending side walls between said top wall and said floor, each side wall curved outwardly in a generally convex manner, said sections disposed adjacent to each other along a substantially horizontal elongation axis, said side walls of adjacent sections joined to each other along substantially vertical lines to define an enclosed equipment chamber, said enclosure having a maximum exterior width and a minimum exterior width measured along lines normal to said elongation axis, said adjacent sections joined to each other at said minimum exterior width; and reinforcing members secured to said sections at said joints between adjacent sections and sized such that said reinforcing members do not extend beyond said maximum exterior width.

2. An enclosure in accordance with claim 1 wherein said reinforcing members comprise I-beams affixed to said sections along said substantially vertical lines.

* * * * *